US008433562B2

(12) United States Patent
Griffin

(10) Patent No.: US 8,433,562 B2
(45) **Date of Patent: *Apr. 30, 2013**

(54) SPEECH CODER THAT DETERMINES PULSED PARAMETERS

(75) Inventor: Daniel W. Griffin, Hollis, NH (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/269,204

(22) Filed: Oct. 7, 2011

(65) Prior Publication Data

US 2012/0089391 A1 Apr. 12, 2012

Related U.S. Application Data

(63) Continuation of application No. 11/615,414, filed on Dec. 22, 2006, now Pat. No. 8,036,886.

(51) Int. Cl.
*G10L 19/00* (2006.01)

(52) U.S. Cl.
USPC ..... 704/216

(58) Field of Classification Search ..... 704/203, 704/214, 216
See application file for complete search history.

(56) References Cited

U.S. PATENT DOCUMENTS

| | | | | |
|---|---|---|---|---|
| 3,622,704 A | | 11/1971 | Ferrieu et al. | |
| 3,903,366 A | | 9/1975 | Coulter | |
| 4,847,905 A | * | 7/1989 | Lefevre et al. | 704/222 |
| 4,932,061 A | * | 6/1990 | Kroon et al. | 704/223 |
| 4,944,013 A | * | 7/1990 | Gouvianakis et al. | 704/219 |
| 5,081,681 A | | 1/1992 | Hardwick et al. | |
| 5,086,475 A | | 2/1992 | Kutaragi et al. | |
| 5,193,140 A | * | 3/1993 | Minde | 704/222 |
| 5,195,166 A | | 3/1993 | Hardwick et al. | |
| 5,216,747 A | | 6/1993 | Hardwick et al. | |
| 5,226,084 A | | 7/1993 | Hardwick et al. | |
| 5,226,108 A | | 7/1993 | Hardwick et al. | |
| 5,247,579 A | | 9/1993 | Hardwick et al. | |
| 5,491,772 A | | 2/1996 | Hardwick et al. | |
| 5,517,511 A | | 5/1996 | Hardwick et al. | |
| 5,581,656 A | | 12/1996 | Hardwick et al. | |
| 5,630,011 A | | 5/1997 | Lim et al. | |
| 5,649,050 A | | 7/1997 | Hardwick et al. | |
| 5,657,168 A | * | 8/1997 | Maruyama et al. | 359/719 |

(Continued)

FOREIGN PATENT DOCUMENTS

| | | |
|---|---|---|
| EP | 0893791 A2 | 1/1999 |
| EP | 1020848 A2 | 7/2000 |

(Continued)

OTHER PUBLICATIONS

Mears, J.C. Jr., "High-speed error correcting encoder/decoder," IBM Technical Disclosure Bulletin USA, vol. 23, No. 4, Oct. 1980, pp. 2135-2136.

*Primary Examiner* — Michael N Opsasnick
(74) *Attorney, Agent, or Firm* — Fish & Richardson P.C.

(57) ABSTRACT

Methods for estimating speech model parameters are disclosed. For pulsed parameter estimation, a speech signal is divided into multiple frequency bands or channels using bandpass filters. Channel processing reduces sensitivity to pole magnitudes and frequencies and reduces impulse response time duration to improve pulse location and strength estimation performance. These methods are useful for high quality speech coding and reproduction at various bit rates for applications such as satellite and cellular voice communication.

23 Claims, 6 Drawing Sheets

Pulsed Analysis Flow Chart

U.S. PATENT DOCUMENTS

| | | | | | |
|---|---|---|---|---|---|
| 5,664,051 | A | | 9/1997 | Hardwick et al. | |
| 5,664,052 | A | | 9/1997 | Nishiguchi et al. | |
| 5,696,874 | A | * | 12/1997 | Taguchi | 704/219 |
| 5,701,390 | A | | 12/1997 | Griffin et al. | |
| 5,715,365 | A | | 2/1998 | Griffin et al. | |
| 5,742,930 | A | | 4/1998 | Howitt | |
| 5,754,974 | A | | 5/1998 | Griffin et al. | |
| 5,826,222 | A | | 10/1998 | Griffin | |
| 5,870,405 | A | | 2/1999 | Hardwick et al. | |
| 5,937,376 | A | * | 8/1999 | Minde | 704/219 |
| 5,963,896 | A | * | 10/1999 | Ozawa | 704/219 |
| 6,018,706 | A | | 1/2000 | Huang et al. | |
| 6,064,955 | A | | 5/2000 | Huang et al. | |
| 6,131,084 | A | | 10/2000 | Hardwick | |
| 6,161,089 | A | | 12/2000 | Hardwick | |
| 6,199,037 | B1 | | 3/2001 | Hardwick | |
| 6,377,916 | B1 | | 4/2002 | Hardwick | |
| 6,484,139 | B2 | | 11/2002 | Yajima | |
| 6,502,069 | B1 | | 12/2002 | Grill et al. | |
| 6,526,376 | B1 | | 2/2003 | Villette et al. | |
| 6,675,148 | B2 | | 1/2004 | Hardwick | |
| 6,895,373 | B2 | | 5/2005 | Garcia et al. | |
| 6,912,495 | B2 | * | 6/2005 | Griffin et al. | 704/208 |
| 6,931,373 | B1 | | 8/2005 | Bhaskar et al. | |
| 6,954,726 | B2 | | 10/2005 | Brandel et al. | |
| 6,963,833 | B1 | | 11/2005 | Singhal | |
| 7,016,831 | B2 | * | 3/2006 | Suzuki et al. | 704/203 |
| 7,289,952 | B2 | * | 10/2007 | Yasunaga et al. | 704/216 |
| 7,394,833 | B2 | | 7/2008 | Heikkinen et al. | |
| 7,421,388 | B2 | | 9/2008 | Zinser et al. | |
| 7,430,507 | B2 | | 9/2008 | Zinser et al. | |
| 7,519,530 | B2 | | 4/2009 | Kaajas et al. | |
| 7,529,660 | B2 | * | 5/2009 | Bessette et al. | 704/205 |
| 7,529,662 | B2 | | 5/2009 | Zinser et al. | |
| 2003/0135374 | A1 | | 7/2003 | Hardwick | |
| 2004/0093206 | A1 | | 5/2004 | Hardwick | |
| 2004/0153316 | A1 | | 8/2004 | Hardwick | |
| 2005/0278169 | A1 | | 12/2005 | Hardwick | |

FOREIGN PATENT DOCUMENTS

| | | | |
|---|---|---|---|
| EP | 1237284 | A1 | 9/2002 |
| JP | 05346797 | A | 12/1993 |
| JP | 10293600 | A | 11/1998 |
| WO | 9804046 | A2 | 1/1998 |

* cited by examiner

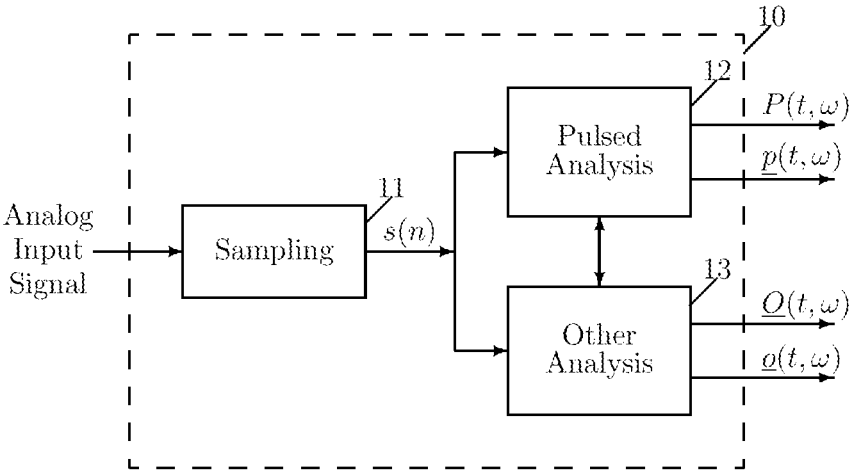
Figure 1: Speech Analysis
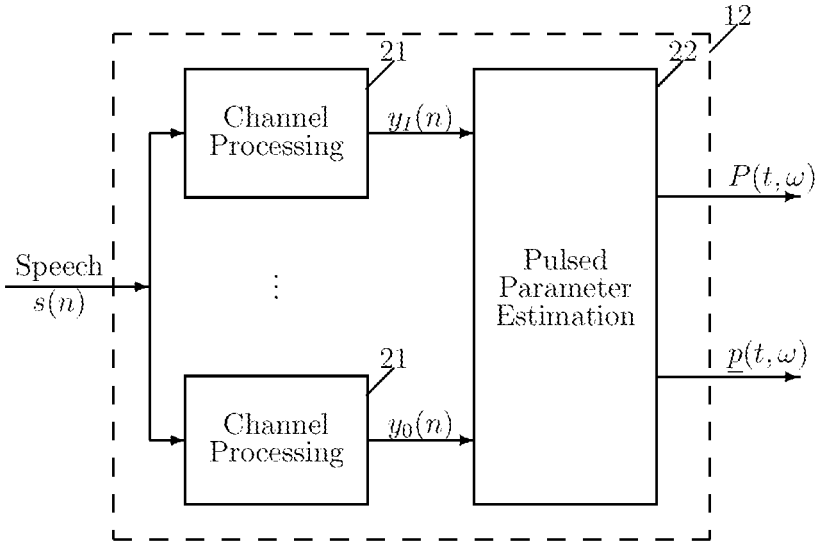
Figure 2: Pulsed Analysis

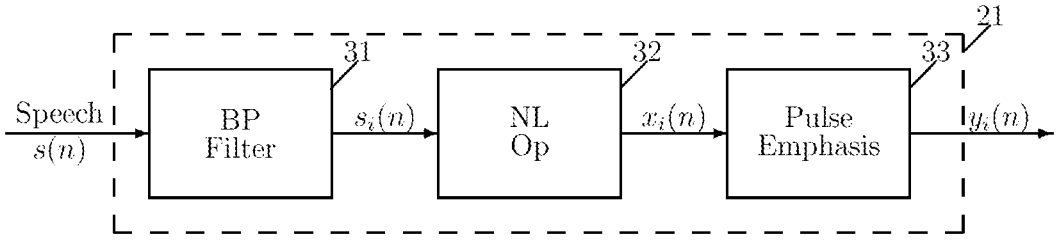
Figure 3: Channel Processing
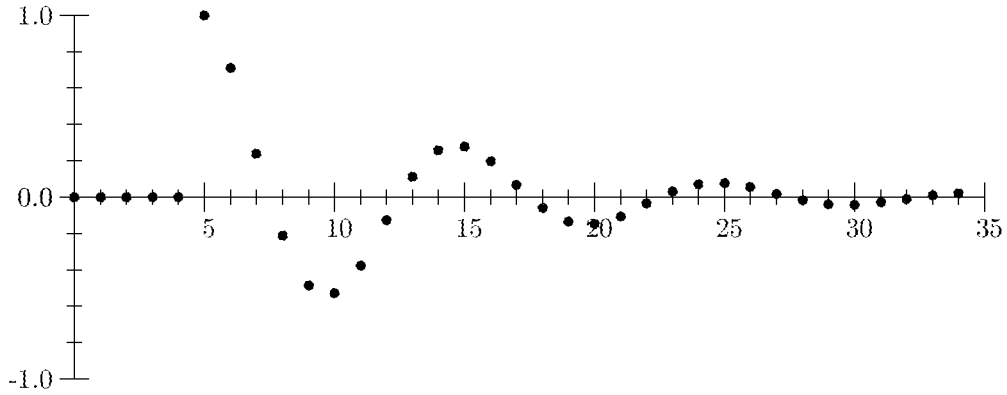
Figure 4: Example 1 - Real Part of Bandpass Filter Output
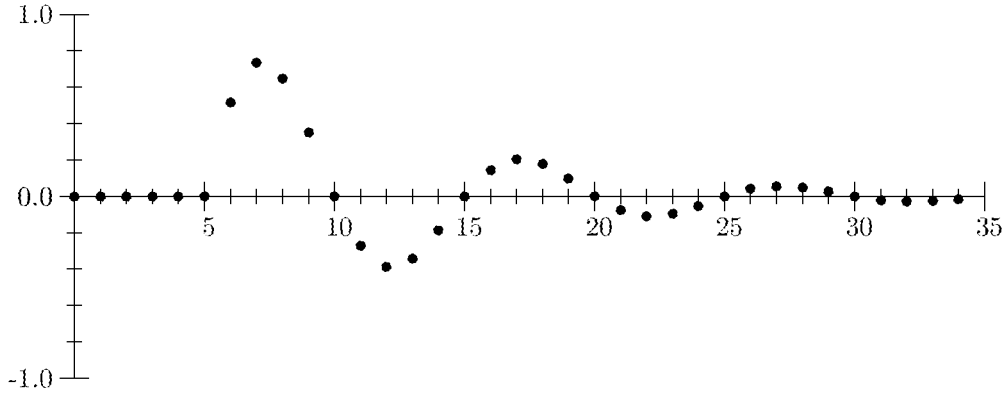
Figure 5: Example 1 - Imaginary Part of Bandpass Filter Output

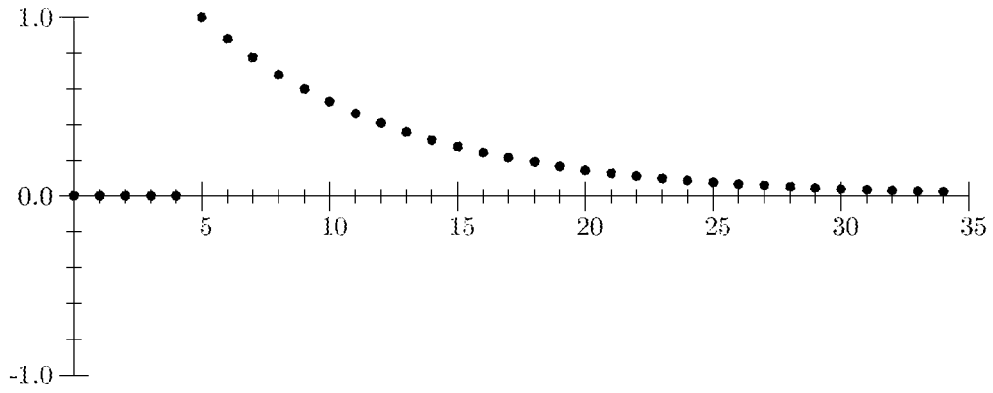
Figure 6: Example 1 - Nonlinear Operation Output
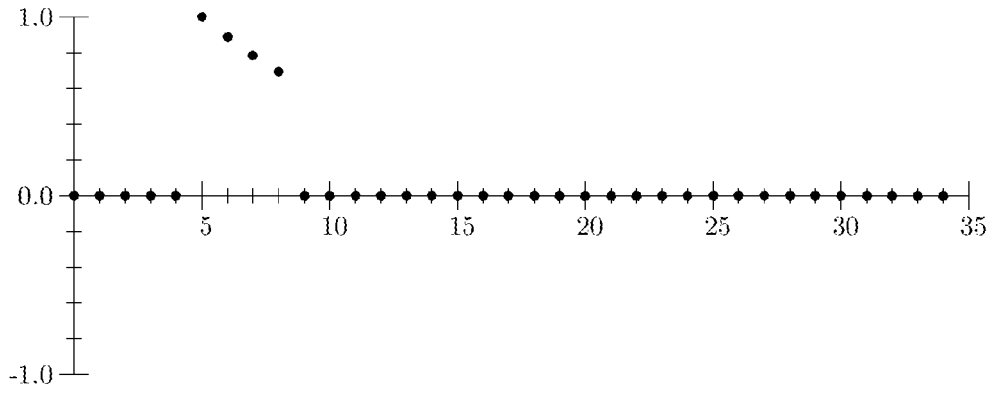
Figure 7: Example 1 - Pulse Emphasis Output
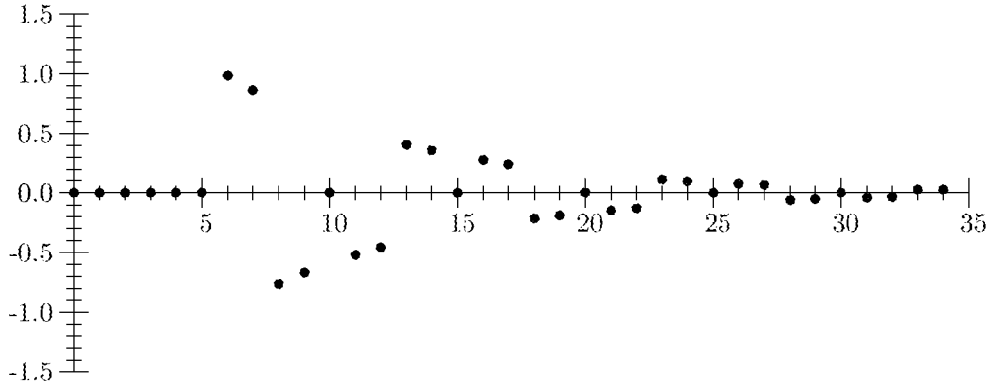
Figure 8: Example 2 - Real Part of Bandpass Filter Output

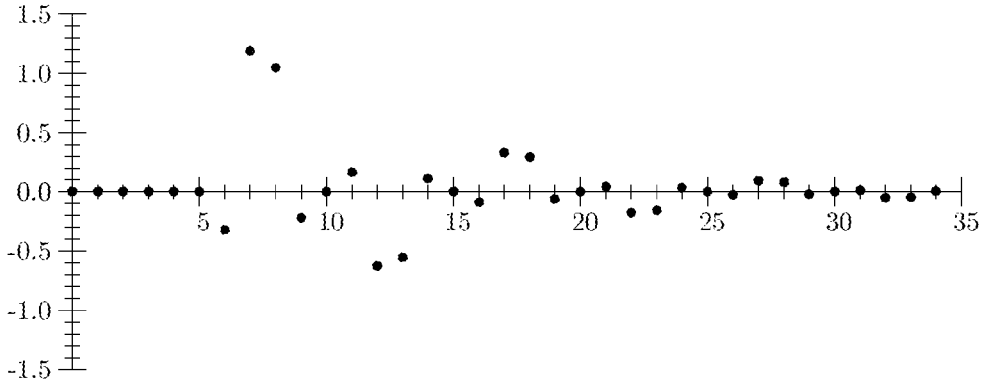
Figure 9: Example 2 - Imaginary Part of Bandpass Filter Output
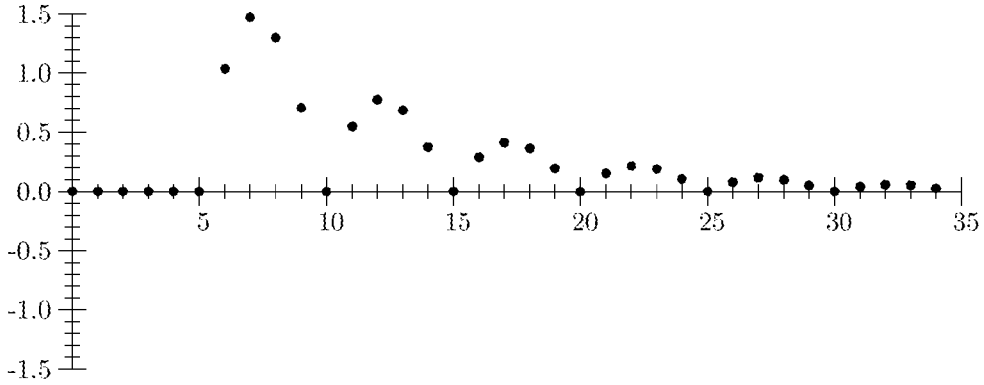
Figure 10: Example 2 - Nonlinear Operation Output
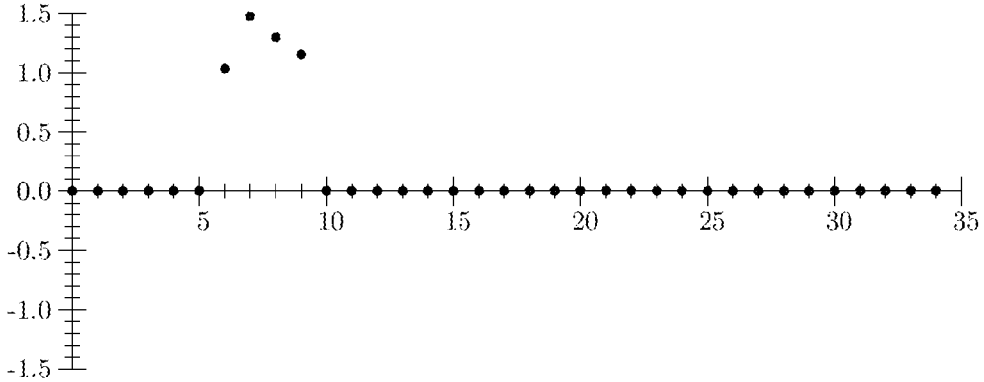
Figure 11: Example 2 - Pulse Emphasis Output

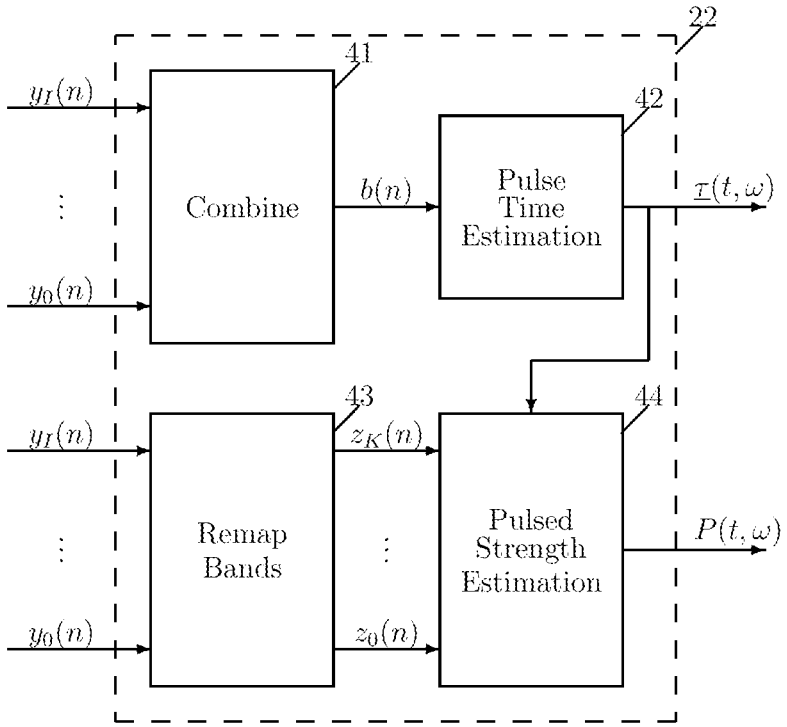
Figure 12: Pulsed Parameter Estimation

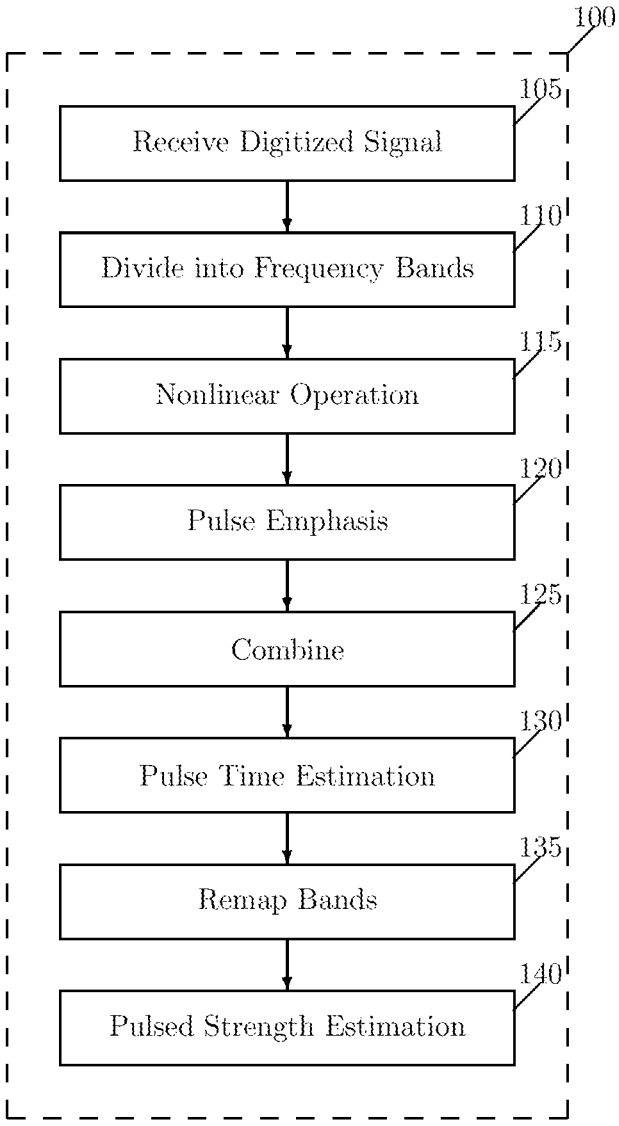
Figure 13: Pulsed Analysis Flow Chart

SPEECH CODER THAT DETERMINES PULSED PARAMETERS

CROSS-REFERENCE TO RELATED APPLICATIONS

This application is a continuation of U.S. application Ser. No. 11 /615 414, filed Dec. 22, 2006, and issued on Oct. 11, 2011 as U.S. Pat. No. 8,036,886; which is incorporated by reference.

BACKGROUND

This document relates to methods and systems for estimation of speech model parameters.

Speech models together with speech analysis and synthesis methods are widely used in applications such as telecommunications, speech recognition, speaker identification, and speech synthesis. Vocoders are a class of speech analysis/synthesis systems based on an underlying model of speech and have been extensively used in practice. Examples of vocoders include linear prediction vocoders, homomorphic vocoders, channel vocoders, sinusoidal transform coders (STC), multiband excitation (MBE) vocoders, improved multiband excitation (IMBE™), and advanced multiband excitation vocoders (AMBE™).

Vocoders typically model speech over a short interval of time as the response of a system excited by some form of excitation. Generally, an input signal s(n) is obtained by sampling an analog input signal. For applications such as speech coding or speech recognition, the sampling rate commonly ranges between 6 kHz and 16 kHz. The method works well for any sampling rate with corresponding changes in the associated parameters. To focus on a short interval centered at time t, the input signal s(n) can be multiplied by a window $\omega(t,n)$ centered at time t to obtain a windowed signal $s_\omega(t,n)$. The window used is typically a Hamming window or Kaiser window which can have a constant shape as a function of t so that $\omega(t,n)=\tilde{\omega}(n-t)$ or can have characteristics which change as a function of t. The length of the window $\omega(t,n)$ generally ranges between 5 ms and 40 ms. The windowed signal $s_\omega(t,n)$ can be computed at center times of $t_0, t_1, \ldots t_m, t_{m+1}, \ldots$. Typically, the interval between consecutive center times $t_{m+1}-t_m$ approximates the effective length of the window w(t,n) used for these center-times. The windowed signal $s_\omega(t,n)$ for a particular center time is often referred to as a segment or frame of the input signal.

For each segment of the input signal, system parameters and excitation parameters are determined. The system parameters typically consist of the spectral envelope or the impulse response of the system. The excitation parameters typically consist of a fundamental frequency (or pitch period) and a voiced/unvoiced (V/UV) parameter which indicates whether the input signal has pitch (or indicates the degree to which the input signal has pitch). For vocoders such as MBE, IMBE, and AMBE, the input signal is divided into frequency bands and the excitation parameters may also include a V/UV decision for each frequency band. High quality speech reproduction may be provided using a high quality speech model, an accurate estimation of the speech model parameters, and high quality synthesis methods.

When the voiced/unvoiced information consists of a single voiced/unvoiced decision for the entire frequency band, the synthesized speech tends to have a "buzzy" quality that is especially noticeable in regions of speech which contain mixed voicing or in voiced regions of noisy speech. A number of mixed excitation models have been proposed as potential solutions to the problem of "buzziness" in vocoders. In these models, periodic and noise-like excitations which have either time-invariant or time-varying spectral shapes are mixed.

In excitation models having time-invariant spectral shapes, the excitation signal consists of the sum of a periodic source and a noise source with fixed spectral envelopes. The mixture ratio controls the relative amplitudes of the periodic and noise sources. Examples of such models are described by Itakura and Saito, "Analysis Synthesis Telephony Based upon the Maximum Likelihood Method," *Reports of 6th Int. Cong. Acoust.*, Tokyo, Japan, Paper C-5-5, pp. C17-20, 1968; and Kwon and Goldberg, "An Enhanced LPC Vocoder with No Voiced/Unvoiced Switch," *IEEE Trans. on Acoust., Speech, and Signal Processing*, vol. ASSP-32, no. 4, pp. 851-858, August 1984. In these excitation models, a white noise source is added to a white periodic source. The mixture ratio between these sources is estimated from the height of the peak of the autocorrelation of the LPC residual.

In excitation models having time-varying spectral shapes, the excitation signal consists of the sum of a periodic source and a noise source with time varying spectral envelope shapes. Examples of such models are described by Fujimara, "An Approximation to Voice Aperiodicity," *IEEE Trans. Audio and Electroacoust.*, pp. 68-72, March 1968; Makhoul et al, "A Mixed-Source Excitation Model for Speech Compression and Synthesis," *IEEE Int. Conf. on Acoust. Sp. & Sig. Proc.*, April 1978, pp. 163-166; Kwon and Goldberg, "An Enhanced LPC Vocoder With No Voiced/Unvoiced Switch," *IEEE Trans. on Acoust., Speech, and Signal Processing*, vol. ASSP-32, no. 4, pp. 851-858, August 1984; and Griffin and Lim, "Multiband Excitation Vocoder," *IEEE Trans. Acoust., Speech, Signal Processing*, vol. ASSP-36, pp. 1223-1235, August 1988.

In the excitation model proposed by Fujimara, the excitation spectrum is divided into three fixed frequency bands. A separate cepstral analysis is performed for each frequency band and a voiced/unvoiced decision for each frequency band is made based on the height of the cepstrum peak as a measure of periodicity.

In the excitation model proposed by Makhoul et al., the excitation signal consists of the sum of a low-pass periodic source and a high-pass noise source. The low-pass periodic source is generated by filtering a white pulse source with a variable cut-off low-pass filter. Similarly, the high-pass noise source is generated by filtering a white noise source with a variable cut-off high-pass filter. The cut-off frequencies for the two filters are equal and are estimated by choosing the highest frequency at which the spectrum is periodic. Periodicity of the spectrum is determined by examining the separation between consecutive peaks and determining whether the separations are the same, within some tolerance level.

In a second excitation model implemented by Kwon and Goldberg, a pulse source is passed through a variable gain low-pass filter and added to itself, and a white noise-source is passed through a variable gain high-pass filter and added to itself. The excitation signal is the sum of the resultant pulse and noise sources with the relative amplitudes controlled by a voiced/unvoiced mixture ratio. The filter gains and voiced/unvoiced mixture ratio are estimated from the LPC residual signal with the constraint that the spectral envelope of the resultant excitation signal is flat.

In the multiband excitation model proposed by Griffin and Lim, a frequency dependent voiced/unvoiced mixture function is proposed. This model is restricted to a frequency dependent binary voiced/unvoiced decision for coding purposes. A further restriction of this model divides the spectrum into a finite number of frequency bands with a binary voiced/ unvoiced decision for each band. The voiced/unvoiced information is estimated by comparing the speech spectrum to the closest periodic spectrum. When the error is below a threshold, the band is marked voiced, otherwise, the band is marked unvoiced.

In U.S. Pat. No. 6,912,495, titled "Speech Model and Analysis, Synthesis, and Quantization Methods" the multiband excitation model is augmented beyond the time and frequency dependent voiced/unvoiced mixture function to allow a mixture of three different signals. In addition to parameters which control the proportion of quasi-periodic and noise-like signals in each frequency band, a parameter is added to control the proportion of pulse-like signals in each frequency band. In addition to the typical fundamental frequency parameter of the voiced excitation, parameters are included which control one or more pulse amplitudes and positions for the pulsed excitation. This model allows additional features of speech and audio signals important for high quality reproduction to be efficiently modeled.

The Fourier transform of the windowed signal $s_\omega(t,n)$ will be denoted by $S_w(t,\omega)$ and will be referred to as the signal Short-Time Fourier Transform (STFT). Suppose s(n) is a periodic signal with a fundamental frequency $\omega_0$ or pitch period $n_0$. The parameters $\omega_0$ and $n_0$ are related to each other by $2\pi/\omega_0=n_0$. Non-integer values of the pitch period $n_0$ are often used in practice.

A speech signal s(n) can be divided into multiple frequency bands or channels using bandpass filters. Characteristics of these bandpass filters are allowed to change as a function of time and/or frequency. A speech signal can also be divided into multiple bands by applying frequency windows or weightings to the speech signal STFT $S_w(t,\omega)$.

SUMMARY

In one aspect, generally, analysis methods are provided for estimating speech model parameters. For pulsed parameter estimation, a speech signal is divided into multiple frequency bands or channels using bandpass filters. Channel processing reduces sensitivity to pole magnitudes and frequencies and reduces impulse response time duration to improve pulse location and strength estimation performance.

The details of one or more implementations are set forth in the accompanying drawings and the description below. Other features and advantages will be apparent from the description and drawings, and from the claims.

BRIEF DESCRIPTION OF THE DRAWINGS

FIG. 1 is a block diagram of an analysis system for estimating speech model parameters.

FIG. 2 is a block diagram of a pulsed analysis unit for estimating pulsed parameters.

FIG. 3 is a block diagram of a channel processing unit.

FIGS. 4-7 are graphs of the real part of a bandpass filter output, the imaginary part of a bandpass filter output, a nonlinear operation output, and a pulse emphasis output for a first example.

FIGS. 8-11 are graphs of the real part of a bandpass filter output, the imaginary part of a bandpass filter output, a nonlinear operation output, and a pulse emphasis output for a second example.

FIG. 12 is a block diagram of a pulsed parameter estimation unit.

FIG. 13 is a flow chart of a pulsed analysis method.

DETAILED DESCRIPTION

FIGS. 1-3 and 12 show the structure of a system for speech analysis, the various blocks and units of which may be implemented with software.

FIG. 1 shows a speech analysis system 10 that estimates model parameters from an input signal. The speech analysis system 10 includes a sampling unit 11, a pulsed analysis unit 12, and an other analysis unit 13. The sampling unit 11 samples an analog input signal to produce a speech signal s(n). It should be noted that sampling unit 11 operates remotely from the analysis units in many applications. For typical speech coding or recognition applications, the sampling rate ranges between 6 kHz and 16 kHz.

The pulsed analysis unit 12 estimates the pulsed strength $P(t,\omega)$ and the pulsed signal parameters $\underline{p}(t,\omega)$ from the speech signal s(n). The other analysis unit 13 estimates other signal parameters $\underline{O}(t,\omega)$ and $\underline{o}(t,\omega)$ from the speech signal s(n). The vertical arrows between analysis units 12 and 13 indicate that information can flow between these units to improve parameter estimation performance.

The other analysis unit can use known methods such as those used for the voiced and unvoiced analysis as disclosed in U.S. Pat. No. 5,715,365, titled "Estimation of Excitation Parameters" and U.S. Pat. No. 5,826,222, titled "Estimation of Excitation Parameters," both of which are incorporated by reference. For example, the other analysis unit may use voiced analysis to produce a set of parameters that includes a voiced strength parameter $V(t,\omega)$ and other voiced signal parameters $\underline{v}(t,\omega)$, which may include voiced excitation parameters and voiced system parameters. The voiced excitation parameters may include a time and frequency dependent fundamental frequency $\omega_0(t,\omega)$ (or equivalently a pitch period $n_0(t,\omega)$). The other analysis unit may also use unvoiced analysis to produce a set of parameters that includes an unvoiced strength parameter $U(t,\omega)$ and other unvoiced signal parameters $\underline{u}(t,\omega)$, which may include unvoiced excitation parameters and unvoiced system parameters. The unvoiced excitation parameters may include, for example, statistics and energy distribution. The described implementation of the pulsed analysis unit uses new methods for estimation 28 of the pulsed parameters. Referring to FIG. 2, the pulsed analysis unit 12 includes channel processing units 21 and a pulsed parameter estimation unit 22. The channel processing units 21 divide the input speech signal into I+1 channels using different filters for each channel. The filter outputs are further processed to produce channel processing output signals $y_0(n)$ through $y_I(n)$. This further processing aids pulsed parameter estimation unit 22 in estimating the pulsed strength $P(t,\omega)$ and the pulsed parameters $\underline{p}(t,\omega)$ from the channel processing output signals $y_0(n)$ through $y_I(n)$.

Referring to FIG. 3, the $i^{th}$ channel processing unit 21 includes bandpass filter unit 31, nonlinear operation unit 32, and pulse emphasis unit 33. The bandpass filter unit and nonlinear operation unit can use known methods as disclosed in U.S. Pat. No. 5,715,365, titled "Estimation of Excitation Parameters". For example, for a received signal s(n) sampled at 8 kHz, bandpass filter units 31 may be implemented by multiplying the received signal s(n) by a Hamming window of length 32 and computing the Discrete Fourier Transform (DFT) of the product using the Fast Fourier Transform (FFT) with length 32. This produces 15 complex bandpass filter outputs (centered at 250 Hz, 500 Hz, . . . , 3750 Hz) and two real bandpass filter outputs (centered at 0 Hz and 4 kHz). The Hamming window may be shifted along the signal s(n) by 4 samples before each multiply and FFT operation to achieve a bandpass filter unit 31 output sampling rate of 2 kHz. The nonlinear operation unit 32 may be implemented using the magnitude operation.

The pulse emphasis unit 33 computes the channel processing, unit output signal $y_i(n)$ from the output of the nonlinear operation unit $x_i(n)$ in the following manner. First, an intermediate signal $a_i(n)$ is computed which quickly follows a rise in $x_i(n)$ and slowly follows a fall in $x_i(n)$.

$$a_i(n)=\max(x_i(n),\alpha a_i(n-1)) \tag{1}$$

where max(a,b)) evaluates to the maximum of a or b. For a 2 kHz sampling rate for signal $x_i(n)$, an exemplary value for $\alpha$ is 0.8853. The value $a_i(-1)$ may be initialized to zero.

The output signal $y_i(n)$ is then computed from $a_i(n)$ using $$y_i(n)=\max(a_i(n)-\beta a_i(n-\delta),0) \tag{2}$$

where exemplary values are $\beta=1.0$ and $\delta=4$.

To illustrate the operation of the pulse emphasis unit, it is useful to consider a few examples. If the output $s_i(n)$ of the bandpass filter unit 31 consists of a discrete time impulse at time $n_1$ exciting a single discrete time complex pole at $\alpha_1=m_1e^{j\omega_1}$, then $s_i(n)$ may be represented as $$s_i(n)=\alpha_1^{n-n_1}u(n-n_1) \tag{3}$$

where the unit step sequence u(n) is defined by $$u(n)=\begin{cases}1, & n\geq 0\\ 0, & n<0\end{cases} \tag{4}$$

FIGS. 4 and 5 show the real and imaginary parts, respectively, of the output of bandpass filter unit 31 with exemplary values of $m_1=0.88$, $\omega_1=0.6283$, and $n_1=5$.

For the signal of Equation 3 and a nonlinear operation consisting of the magnitude, the output of nonlinear operation unit 32 is $$x_i(n)=|\alpha_1|^{n-n_1}u(n-n_1). \tag{5}$$

FIG. 6 illustrates the output of the nonlinear operation unit 32 for the exemplary values noted above. The intermediate signal becomes $$a_i(n)=\alpha^{n-n_1}u(n-n_1) \tag{6}$$

when $\alpha\geqq|\alpha_1|$. The benefit of the processing of Equation (1) is a reduction in sensitivity to the pole magnitude $|\alpha_1|$. To obtain this reduction in sensitivity, $\alpha$ should be selected so that it is greater than most pole magnitudes typically seen in speech, signals.

The pole magnitude is related to the bandwidth of the frequency response (poles with magnitude closer to unity have narrower bandwidths). The pole magnitude also governs the rate of decay of the impulse response. For stable systems with pole magnitude less than unity, a smaller pole magnitude leads to faster decay of the impulse response.

For the $a_i(n)$ of Equation (6), the channel processing output, is $$y_i(n)=\alpha^{n-n_1}(u(n-n_1)-u(n-n_1-\delta)). \tag{7}$$

This signal is nonzero only in the interval $n_1\leqq n\leqq n_1+\delta$ (see FIG. 7 for an exemplary value of $y_i(n)$ when $\alpha=0.8853$). This concentration of the impulse response to a short interval aids pulse location and strength estimation in subsequent processing.

As a second example, consider an output $s_i(n)$ of the bandpass filter unit 31 which consists of a discrete time impulse at time $n_1+1$ exciting discrete time complex poles at $\alpha_1=m_1e^{j\omega_1}$ and $\alpha_2=m_2^{j\omega_2}$ where $\alpha_1\neq\alpha_2$ and the magnitudes $m_1$ and $m_2$ are less than unity:

$$s_i(n)=\alpha_1^{n-n_1}u(n-n_1)-\alpha_2^{n-n_1}u(n-n_1). \tag{8}$$

FIGS. 8 and 9 show the real and imaginary parts, respectively, of the output of bandpass filter unit 31 with exemplary values of $m_1=m_2=0.88$, $\omega_1=0.6283$, $\omega_2=1.885$, and $n_1=5$.

For the signal of Equation 8 and a nonlinear operation consisting of the magnitude, the output of nonlinear operation unit 32 (an example of which is shown in FIG. 10) is $$x_i(n)=u(n-n_1)\sqrt{m_1^{2(n-n_1)}-2m_1^{n-n_1}m_2^{n-n_1}\cos((\omega_1-\omega_2)(n-n_1))+m_2^{2(n-n_1)}}. \tag{9}$$

For exemplary values of $m_1=m_2=0.88$, $\omega_1=0.6283$, and $\omega_2=1.885$, the global maximum of Equation (9) occurs at $n=n_1+2$. Subsequent local maxima occur at $n=n_1+7$, 12, 17, 22, . . . and are caused by beating between the two pole frequencies $\omega_1$ and $\omega_2$. For simple pulse estimation methods, these subsequent local maxima can cause false pulse detections. However, when processed by the method of Equation (1) with $\alpha\geqq0.88$, $a_i(n)$ follows $x_i(n)$ up to the global maximum at $n=n_1+2$. Thereafter, it decays but remains above subsequent local maxima and consequently the only maxima of $a_i(n)$ is the global maximum at $n=n_1+2$. For this example, the channel processing output $y_i(n)$ of Equation (2) is nonzero only in the interval $n_1+1\leqq n\leqq n_1+\delta$ (see FIG. 11). Again, the impulse response is concentrated to a short interval, which aids pulse location and strength estimation in subsequent processing. It should be noted that, for this case, the channel processing reduces sensitivity to both the pole magnitudes and frequencies.

FIG. 12 shows a pulsed parameter estimation unit 22 that includes a combine unit 41, a pulse time estimation unit 42, a remap bands unit 43, and a pulsed strength estimation unit 44. Combine unit 41 combines channel processing output signals $y_0(n)$ through $y_I(n)$ into an intermediate signal b(n) to reduce computation in pulse time estimation unit 42.

$$b(n)=\sum_{i=0}^{I}\gamma_i y_i(n) \tag{10}$$

One simple implementation uses equal weighting ($\gamma_i=1$) for each channel. A second implementation computes the channel weights $\gamma_i$ using a voicing strength estimate so that channels that are determined to be more voiced are weighted less when they are combined to produce b(n). For example $\gamma_i=1-V(t,\omega_i)$ may be used where $V(t,\omega_i)$ is the estimated voicing strength for the current frame and $\omega_i$ is the center frequency of channel i.

Pulse time estimation unit 42 estimates pulse times (or equivalently pulse time onsets, positions, or locations) from intermediate signal b(n). The pulse times are estimates of the times at which a short pulse of energy excites a system such as the vocal tract. One implementation first multiplies b(n) by a framing window $\omega_1(t,n)$ centered at frame time t to generate a windowed signal $b_\omega(t,n)$. A second window $\omega_2(l)$ is then correlated with signal $b_\omega(t,n)$ to produce signal c(t,n):

$$c(t, n) = \sum_{l=0}^{L-1} w_2(l) b_w(t, n+l) \tag{11}$$

For each frame centered at time t, a first pulse time estimate $\tau_0(t)$ is selected as the value of n at which correlation c(t,n) achieves its maximum. One implementation uses a rectangular framing window $$w_1(t, n) = \tilde{w}_1(n-t) = \begin{cases} 1, & |n-t| < \frac{N}{2} \\ 0, & \text{otherwise} \end{cases} \tag{12}$$

and a rectangular correlation window (or pulse location signal)

$$w_2(l) = \begin{cases} 1, & 0 \le l \le L-1 \\ 0, & \text{otherwise} \end{cases} \tag{13}$$

with N=35 and L=8 for a sampling frequency of 2 kHz. Tapered windows such as Hamming or Kaiser windows may also be used. The pulse location signal $w_2(l)$ may, more generally, be a signal a with a low pass frequency response. For this example, a single pulse time estimate $\tau_0(t)$ that is independent of ω is used for each frame and so the pulse time estimates $\underline{\tau}(t,\omega)$ consist of the single time estimate $\tau_0(t)$.

Remap bands unit 43 can use known methods such as those disclosed in U.S. Pat. No. 5,715,365, titled "Estimation of Excitation Parameters" and U.S. Pat. No. 5,826,222, titled "Estimation of Excitation Parameters," for transforming a first set of channels or frequency band signals $y_0(n)$ through $y_I(n)$ into a second set $z_0(n)$ through $z_K(n)$. Typical values are 16 channels in the first set and 8 channels in the second set. An exemplary remap bands unit 43 assigns $z_0(n)=y_1(n)$, $z_1(n)=y_2(n)+y_3(n)$, $z_2(n)=y_4(n)+y_5(n)$, . . . , $z_7(n)=y_{14}(n)+y_{15}(n)$. In this example, $y_0(n)$ is not used since performance is often degraded if the lowest frequencies are included.

Pulse strength estimation unit 44 estimates the pulsed strength P(t,ω) from the remapped channels $z_0(n)$ through $z_K(n)$ and the pulse time estimates $\underline{\tau}(t,\omega)$. One implementation computes a pulse strength estimate for each remapped channel by first estimating an error function $\epsilon_k(t)$.

$$e_k(t) = 1.0 - \frac{\sum_{l=0}^{L-1} w_2(l) z_k(\tau_0(t)+l)}{D_k(t)} \tag{14}$$

where $$D_k(t) = \sum_{n=\lceil t-N/2 \rceil}^{\lfloor t+N/2 \rfloor} \tilde{w}_1(n-t) z_k(n), \tag{15}$$

the ceiling function $\lceil x \rceil$ evaluates to the least integer greater than or equal to x, and the floor function $\lfloor x \rfloor$ evaluates to the greatest integer less than or equal to x.

The pulse strength is estimated using $$P(t, \omega) = \begin{cases} 0, & P'(t\omega) < 0 \\ P'(t, \omega), & 0 \le P'(t\omega) \le 1 \\ 1, & P'(t, \omega) > 1 \end{cases} \tag{16}$$

where $$P'(t, \omega_k) = \frac{1}{2}\log_2\left(\frac{2T_p}{e_k(t)}\right), \tag{17}$$

$\omega_k$ is the center frequency of the $k^{th}$ remapped channel, $T_p$ is a threshold that may be set, for example, to 0.133, and $P'(t,\omega_k)$ is set to be 1 when $e_k(t)=0$.

The estimated pulse strength P(t,ω) may be jointly quantized with other strengths such as the voiced strength V(t,ω) and the unvoiced strength U(t,ω) using known methods such as those disclosed in U.S. Pat. No. 5,826,222, titled "Estimation of Excitation Parameters". One implementation uses a weighted vector quantizer to jointly quantize the strength parameters from two adjacent frames using 7 bits. The strength parameters are divided into 8 frequency bands. Typical band edges for these 8 frequency bands for an 8 kHz sampling rate are 0 Hz, 375 Hz, 875 Hz, 1375 Hz, 1875 Hz, 2375 Hz, 2875 Hz, 3375 Hz, and 4000 Hz. The codebook for the vector quantizer contains 128 entries consisting of 16 quantized strength parameters for the 8 frequency bands of two adjacent frames. To reduce storage in the codebook, the entries are quantized so that, for a particular frequency band, a value of zero is used for entirely unvoiced, a value of one is used for entirely voiced, and a value of two is used for entirely pulsed.

The pulse time estimates $\underline{\tau}(t,\omega)$ may be jointly quantized with fundamental frequency estimates using known methods such as those disclosed in U.S. Pat. No. 5,826,222, titled "Estimation of Excitation Parameters". For example, the fundamental and pulse time estimates for two adjacent frames may be quantized based on the quantized strength parameters for these frames as set forth below.

First, if the quantized voiced strength $\check{V}(t,\omega)$ is non-zero at any frequency for the two current frames, then the two fundamental frequencies for these frames may be jointly quantized using 9 bits, and the pulse time estimates may be quantized to zero (center of window) using no bits.

Next, if the quantized voiced strength $\check{V}(t,\omega)$ is zero at all frequencies for the two current frames and the quantized pulsed strength $\check{P}(t,\omega)$ is non-zero at any frequency for the current two frames, then the two pulse time estimates for these frames may be quantized using, for example, 9 bits, and the fundamental frequencies are set to a value of, for example, 64.84 Hz using no bits.

Finally, if the quantized voiced strength $\check{V}(t,\omega)$ and the quantized pulsed strength $\check{P}(t,\omega)$ are both zero at all frequencies for the current two frames, then the two pulse positions for these frames are quantized to zero, and the fundamental frequencies for these frames may be jointly quantized using 9 bits.

These techniques may be used in a typical speech coding application by dividing the speech signal into frames of 10 ms using analysis windows with effective lengths of approximately 10 ms. For each windowed segment of speech, voiced, unvoiced, and pulsed strength parameters, a fundamental frequency, a pulse position, and spectral envelope samples are estimated. Parameters estimated from two adjacent frames may be combined and quantized at 4 kbps for transmission over a communication channel. The receiver decodes the bits and reconstructs the parameters. A voiced signal, an unvoiced signal, and a pulsed signal are then synthesized from the reconstructed parameters and summed to produce the synthesized speech signal.

FIG. 13 illustrates an exemplary embodiment of a pulsed analysis method 100. Pulsed analysis method 100 may be implemented in hardware or software as part of a speech coding or speech recognition system. The method 100 may begin with a receives a digitized signal that may include samples from a local or remote A/D converter or from memory (105).

Next, the digitized signal is divided into two or more frequency band signals using bandpass filters (110). The bandpass filters may be complex or real and may be finite impulse response (FIR) or infinite impulse response (IIR) filters.

A nonlinear operation then is applied to the frequency band signals (115). The nonlinear operation may be implemented as the magnitude operation and reduces sensitivity to pole frequencies in the frequency band signals.

Pulse emphasis then is applied (120). Pulse emphasis includes operations to emphasize the onset of pulses to improve the performance of later pulse time estimation and pulsed strength estimation steps while reducing sensitivy to pole parameters of the frequency band signals. For example, an operation which quickly follows arise in the output of the nonlinear operation and slowly follows a fall in the output of the nonlinear operation may be used to produce fast-rise, slow-decay frequency band signals that preserve pulse onsets while reducing sensitivity to pole parameters of the frequency band signals. The pulse onsets, may be emphasized by subtracting a weighted sum of previous samples of the fast-rise, slow-decay frequency band signals from the current value to produce emphasized frequency band signals.

The emphasized frequency band signals then are combined (125). This combining reduces computation in the following pulse time estimation step.

Pulse time estimation then is applied to estimate the pulse onset times (or pulse positions or locations) from the combined emphasized frequency band signals (130). Pulse time estimation may be performed, for example, by the pulse time estimation unit 42.

Remapping of bands then is applied to transform a first set of emphasized frequency band signals into a second set of remapped emphasized frequency band signals (135). Remapping may be performed, for example, by the remap bands unit 43.

Pulsed strength estimation then is performed to estimate the pulsed strength from the remapped emphasized frequency band signals and the pule time estimates (140). Pulse strength estimation may be performed, for example, by the pulsed strength estimation unit 44.

Other implementations are within the following claims.

What is claimed is:

1. A speech coder configured to analyze a digitized signal to determine model parameters for the digitized signal, the speech coder being operable to:

receive a digitized signal;

divide the digitized signal into at least two frequency band signals;

perform an operation to emphasize pulse positions on at least two frequency band signals to produce modified frequency band signals;

determine pulsed parameters from the at least two modified frequency band signals.

2. The speech coder of claim 1, wherein the speech coder is operable to determine pulsed parameters at regular intervals of time.

3. The speech coder of claim 1, wherein the speech coder is operable to use the pulsed parameters to encode the digitized signal.

4. The speech coder of claim 1, wherein the operation to emphasize pulse positions includes an operation to reduce sensitivity to pole magnitudes.

5. The speech coder of claim 1, wherein the operation to emphasize pulse positions includes an operation to reduce sensitivity to pole frequencies.

6. The speech coder of claim 1, wherein the operation to emphasize pulse positions includes an operation to reduce pulse time duration.

7. The speech coder of claim 1, wherein the speech coder is operable to remap the modified frequency band signals into a set of remapped modified frequency band signals.

8. The speech coder of claim 7, wherein the speech coder is operable to determine the pulsed strength of a remapped modified frequency band signal using one or more pulse positions estimated from the digitized signal.

9. The speech coder of claim 8, wherein the speech coder is operable to determine the pulsed strength by comparing a weighted sum of the remapped modified frequency band signal around the estimated pulse positions to the total weighted sum over the frame window.

10. The speech coder of claim 1, wherein the pulsed parameters include a pulsed strength.

11. The speech coder of claim 10, wherein the speech coder is operable to use a voiced strength in determining the pulsed strength.

12. The speech coder of claim 10, wherein the speech coder is operable to determine the pulsed strength using one or more pulse positions estimated from the digitized signal.

13. The speech coder of claim 10, wherein the speech coder is operable to use the pulsed strength to estimate one or more model parameters.

14. The speech coder of claim 1, wherein the pulsed parameters include pulse positions.

15. The speech coder of claim 14, wherein the speech coder is operable to estimate the pulse positions from a combination of the modified frequency band signals.

16. The speech coder of claim 15, wherein the speech coder is operable to estimate the pulse positions from the combination by correlation with a pulse location signal.

17. The speech coder of claim 16, wherein the pulse location signal is low pass.

18. The speech coder of claim 16, wherein the speech coder is operable to estimate a pulse position by choosing the location at which the correlation is maximum.

19. The speech coder of claim 1, wherein the operation to emphasize pulse positions includes a nonlinearity.

20. The speech coder of claim 19, wherein the operation to emphasize pulse positions further includes an operation which quickly follows a rise in the output of the nonlinearity and slowly follows a fall in the output of the nonlinearity to produce fast rise slow decay frequency band signals.

21. The speech coder of claim 20, wherein the speech coder is operable to further process the fast rise, slow decay frequency band signals to emphasize pulse onsets.

22. The speech coder of claim 21, wherein the speech coder is operable to emphasize pulse onsets by subtracting a weighted sum of previous samples of the fast rise, slow decay frequency band signals from the current value to produce emphasized frequency band signals.

23. The speech coder of claim 22, wherein the speech coder is operable to further process the emphasized frequency band signals using a rectifier operation that preserves positive values and clamps negative values to zero.

* * * * *